United States Patent [19]

Paciorek

[11] 4,300,134

[45] Nov. 10, 1981

[54] AUTOMATIC RESETTING ANTI 2-BLOCK CRANE WARNING SYSTEM

[75] Inventor: Raymond M. Paciorek, Downers Groves, Ill.

[73] Assignee: Eaton Corporation, Cleveland, Ohio

[21] Appl. No.: 105,684

[22] Filed: Dec. 20, 1979

[51] Int. Cl.[3] ..... G08B 21/00

[52] U.S. Cl. ..... 340/685; 200/47; 212/152

[58] Field of Search ..... 340/685; 212/152; 200/47; 307/205, 207

[56] References Cited

U.S. PATENT DOCUMENTS

| | | | |
|---|---|---|---|
| 3,391,906 | 7/1968 | Duerst | 212/152 |
| 3,922,789 | 12/1975 | Sarrell | 340/685 |
| 3,969,714 | 7/1976 | Greer | 340/685 |
| 4,178,591 | 12/1979 | Geppert | 340/685 |

OTHER PUBLICATIONS

"Anti-Two-Block Warning System", Form No. 1511778-5M of Grove Mfg. Co., supplied by applicant.

*Primary Examiner*—Glen R. Swann, III

*Attorney, Agent, or Firm*—R. J. McCloskey; R. A. Johnston

[57] ABSTRACT

An automatic resetting anti 2-BLOCK condition crane warning system gives audible and visual warning of an imminent 2-BLOCK condition and prevents occurrence of an actual 2-BLOCK condition by means of a control output signal. The warning system is further operable to permit override of the indication of and control against the 2-BLOCK condition. Three distinct audible and visual indications are provided for NORMAL, 2-BLOCK, and OVERRIDE system states. The system is further operative to automatically reset to a NORMAL state from either a 2-BLOCK or OVERRIDE state upon sensing a transition from a 2-BLOCK condition to a NORMAL condition.

13 Claims, 9 Drawing Figures

AUTOMATIC RESETTING ANTI 2-BLOCK CRANE WARNING SYSTEM

BACKGROUND OF THE INVENTION

In lifting crane service, a 2-BLOCK condition defined as physical contact of a hook block with a boom point or associated boom point apparatus may occur. Heretofore, equipment used in lifting crane service such as mobile cranes either relied entirely on operator skill for safety and did not have a 2-BLOCK condition warning system or had a 2-BLOCK condition warning system which would indicate an imminent 2-BLOCK condition and prevent it from occurring. Operators have heretofore sometimes found it necessary to intentionally cause a 2-BLOCK condition to prevent the hook block from swaying when the mobile crane is in transit. Furthermore, during lifting crane service, operators have occasionally found it necessary or desirable to obtain the absolute maximum lifting height available from the crane, thus necessitating operation close to or actually in a 2-BLOCK condition.

In prior art systems having a 2-BLOCK condition warning or prevention feature, a manual override feature was sometimes provided to enable intentional operation in a 2-BLOCK condition. Such a manual override feature further required manual resetting from the OVERRIDE state when operation in a 2-BLOCK condition was terminated. Such a system is disadvantageous because it relies on the operator to take affirmative action to restore the system to its monitoring state.

SUMMARY OF THE INVENTION

The system disclosed herein overcomes these disadvantages by providing an automatic resetting anti 2-BLOCK condition warning system having distinct indication states for a NORMAL condition, a 2-BLOCK condition and an OVERRIDE state. In addition to sensing and indicating a NORMAL or 2-BLOCK condition and providing a control output when in a NORMAL state and removing the control output when in a 2-BLOCK state, the system disclosed herein will automatically reset itself when crane operation moves from a 2-BLOCK to a NORMAL condition, restoring indication and control output states associated with a NORMAL condition.

The OVERRIDE state is manually induced by the crane operator but automatically terminates itself after a brief period of time, restoring the system to indication and control of the condition that then exists; e.g. either NORMAL or 2-BLOCK. Safety and convenience of crane operation are enhanced by not requiring the operator to take affirmative action, either to terminate the OVERRIDE state, or to reset from a 2-BLOCK indicating state to a NORMAL indicating state.

The present invention thus overcomes the above described shortcomings of prior art crane systems by providing an automatic resetting anti 2-BLOCK condition warning system comprising a detector which receives a sensed condition input and an override input and provides a three state indicator output and a two state control output, with the detector providing a NORMAL indication state and a control signal output upon receipt of a first sensed input condition in the absence of an override input signal, a 3-BLOCK indication state and no control signal output upon receipt of a second sensed condition input in the absence of an override input, and an OVERRIDE indication state and a control signal output upon receipt of an override input signal regardless of the state of the sensed condition input signal.

According to another aspect of the invention, the detector will provide an indication of and control signal state appropriate to the sensed condition input automatically after a time interval of an OVERRIDE state.

According to another aspect of the invention, the detector will reset automatically from indication of a second sensed condition or an OVERRIDE state to a NORMAL state upon receipt of a first sensed condition input.

BRIEF DESCRIPTION OF THE DRAWINGS

FIG. 5 is an enlarged view of a portion of FIG. 1, showing the 2-BLOCK switch in its environment.

DETAILED DESCRIPTION OF THE INVENTION

System Overview

Figure 1:
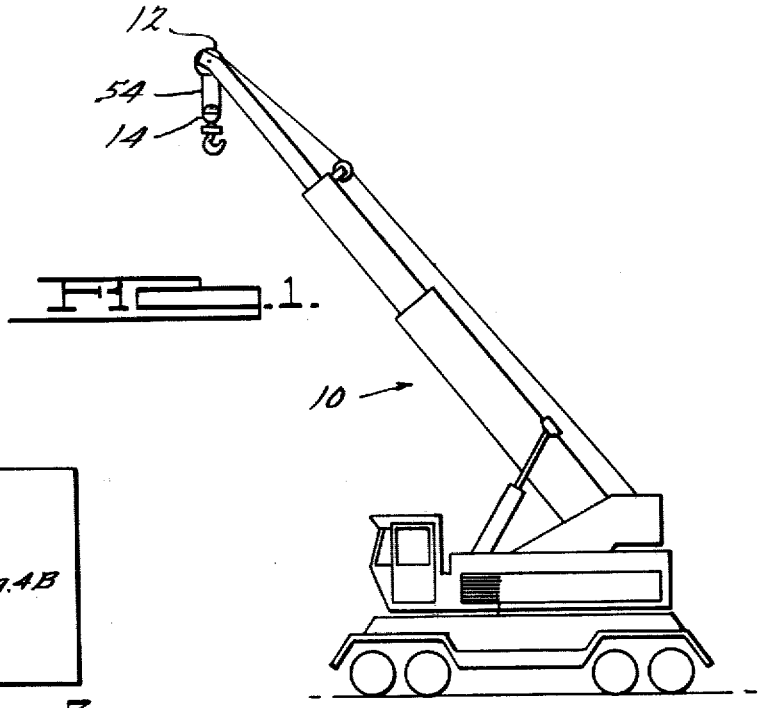
FIG. 1 shows a mobile crane of the type which utilizes an automatic resetting anti 2-BLOCK condition warning system.
Figure 3:
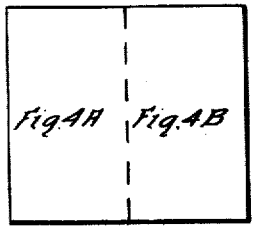
FIG. 3 is a drawing key for FIGS. 4A and 4B.

Referring to FIG. 1 a mobile crane indicated generally at 10 is shown having a lifting point at upper load block 12 and a movable hook block 14 suspended by a reeving of hoist cable 54.

Figure 2:
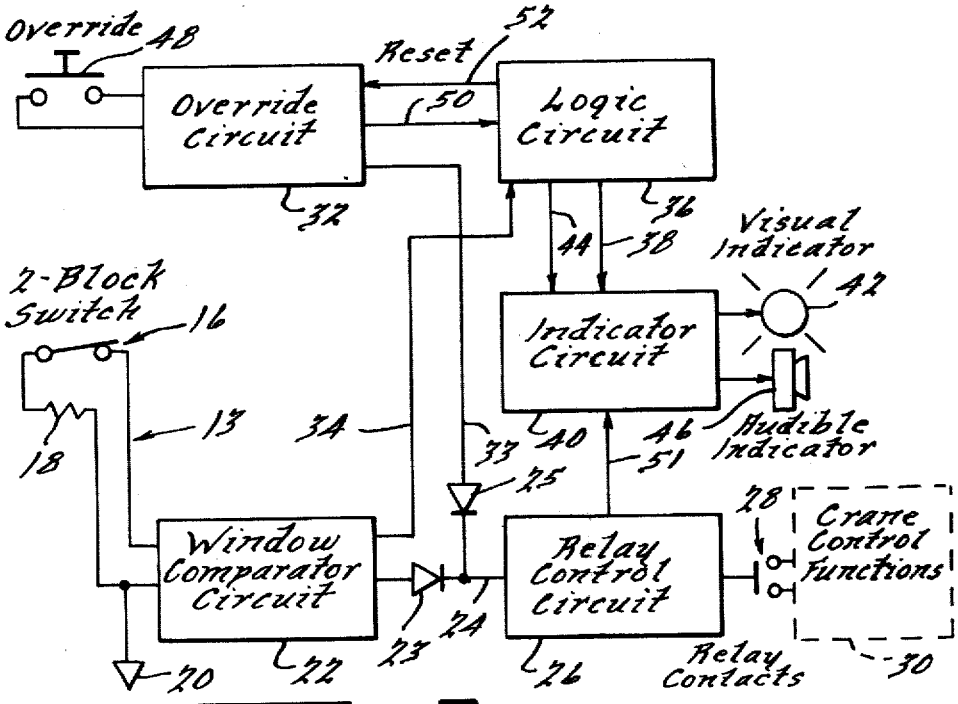
FIG. 2 is a block diagram of the 2-BLOCK condition warning system.

Referring to FIG. 2, 2-block switch indicated generally at 16 senses proximity of movable block 14 to upper load block 12. Both 2-block switch 16 and resistor 18 are located at upper load block 12, shown in more detail in FIGS. 5 through 8. The condition of the 2-block switch is sensed by window comparator circuit 22. In addition, circuit 22 will detect an open or shorted condition of the two conductor electrical cable 13 between 2-block switch 16 and circuit 22. Window comparator circuit 22 detects a 2-BLOCK condition when 2-block switch 16 is open, or when the electrical cable 13 interconnecting switch 16 to circuit 22 is open or shorted. When window comparator 22 senses that 2-block switch 16 is closed, the signal on lead 24 energizes relay control circuit 26, closing relay contacts 28 and enabling crane control function 30. Diodes 23 and 25 comprise an OR gate at input lead 24 of relay control circuit 26. The OR gate permits either a NORMAL state signal from window comparator circuit 22 or an OVERRIDE state signal received from override circuit 32 to energize relay control circuit 26.

When window comparator circuit 22 detects a 2-BLOCK condition, no signal is transmitted on lead 24; and, in the absence of an OVERRIDE state, relay control circuit 26 will be deenergized opening relay contacts 28 and disabling crane control functions 30. Examples of typical crane control functions which would be controlled are: (a) hoist elevation, (b) boom extension, and (c) boom lowering.

When window comparator circuit 22 senses a NORMAL condition at its input it also sends a signal on lead 34 to logic circuit 36 which sends a signal on lead 38 to indicator circuit 30 causing visual indicator 42 to be in its "on" or NORMAL state thereby indicating a NORMAL condition. By means of the same digital path, visual indicator 42 is shut off when window comparator circuit 22 detects a 2-BLOCK condition. In the presently preferred practice the indicator circuit 40 is such that no audible indication is given when the NORMAL condition is sensed. However, it will be recognized that other indicator arrangements may be employed if desired. Relay control circuit 26 provides a signal on lead 51 to indicator circuit 40 which provides for a continuous signal from audible indicator 46 whenever relay circuit 26 is deenergized, indicative of a 2-BLOCK condition.

The operator may depress the override push button 48 activating override circuit 32 while a NORMAL or 2-BLOCK condition is sensed. Once override circuit 32 is activated it will temporarily energize relay control circuit 26 through diode 25 and lead 24, closing relay contacts 28. Concurrently, override circuit 32 will provide a signal to logic circuit 36 by means of lead 50 which will cause visual indicator 42 and audible indicator 46 to provide a pulsating annunciation to indicate that the system is in an OVERRIDE state.

Logic circuit 36 provides a reset signal on lead 52 to override circuit 32 whenever a transition to a NORMAL condition is sensed. The signal on lead 52 will automatically reset the system from a 2-BLOCK or OVERRIDE state to the NORMAL state each time the 2-block switch 16 closes, which will occur each time hook block 14 moves out of a 2-BLOCK condition with upper load block 12.

Hereinafter, unless otherwise specifically noted, resistance values are given in ohms, capacitance values given as "mf" denote microfarads and diodes are type 1N914. Circuit common is indicated by an inverted triangle 20 throughout the electrical drawings.

Figure 4A:
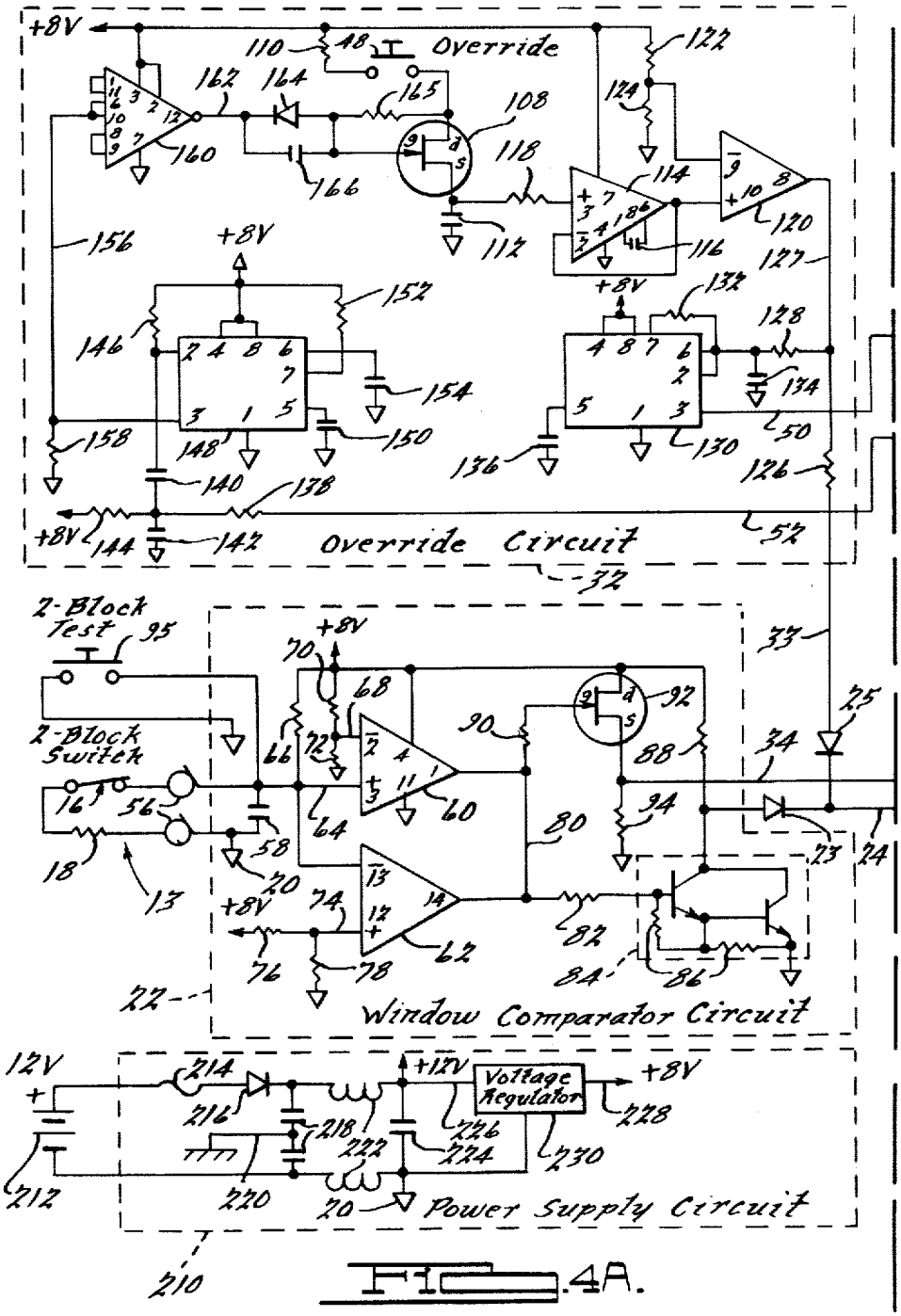
FIGS. 4A and 4B collectively comprise a detailed electronic schematic for the automatic resetting 2-BLOCK condition warning system.
Figure 4B:
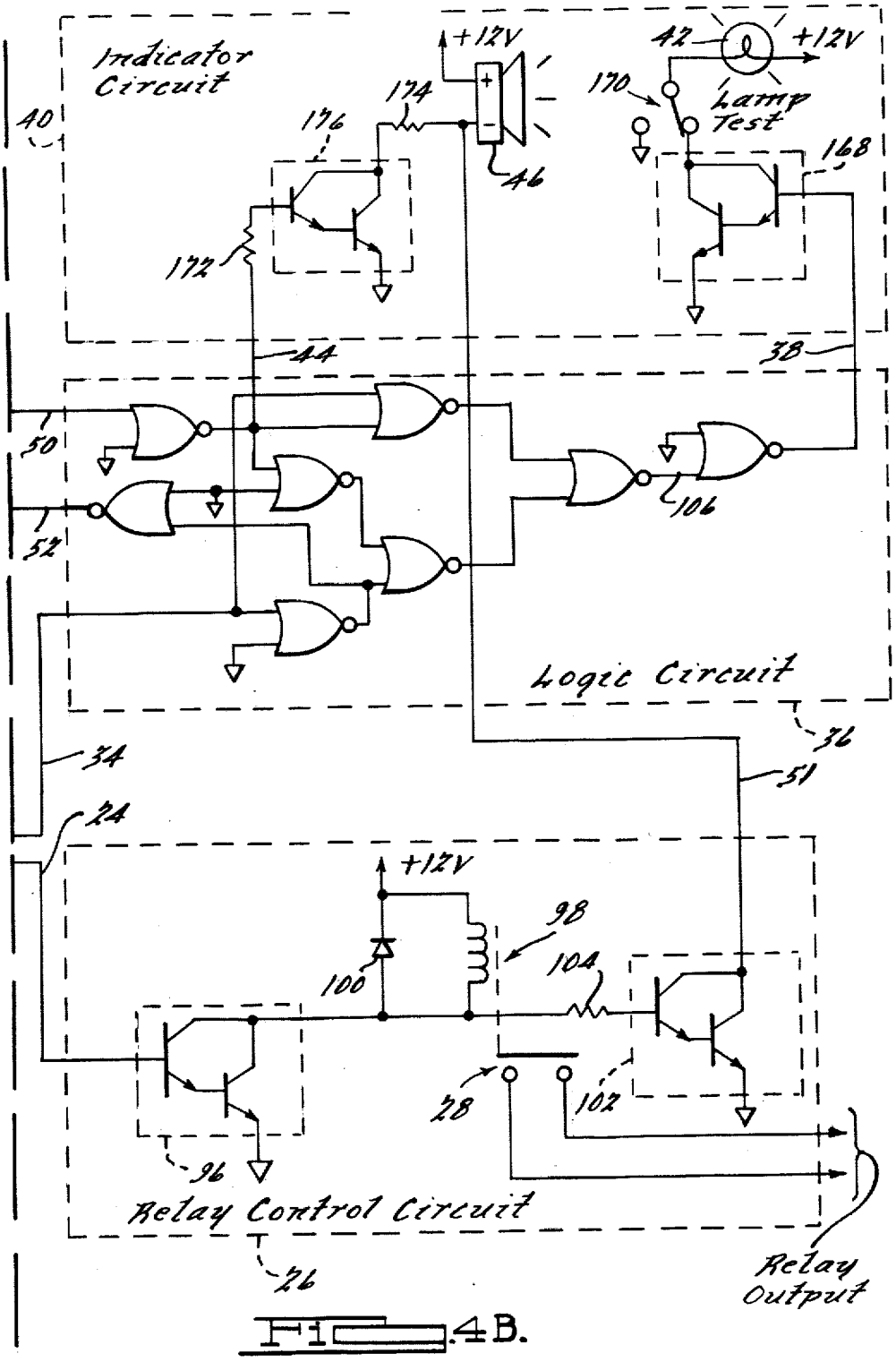
Figure 9:
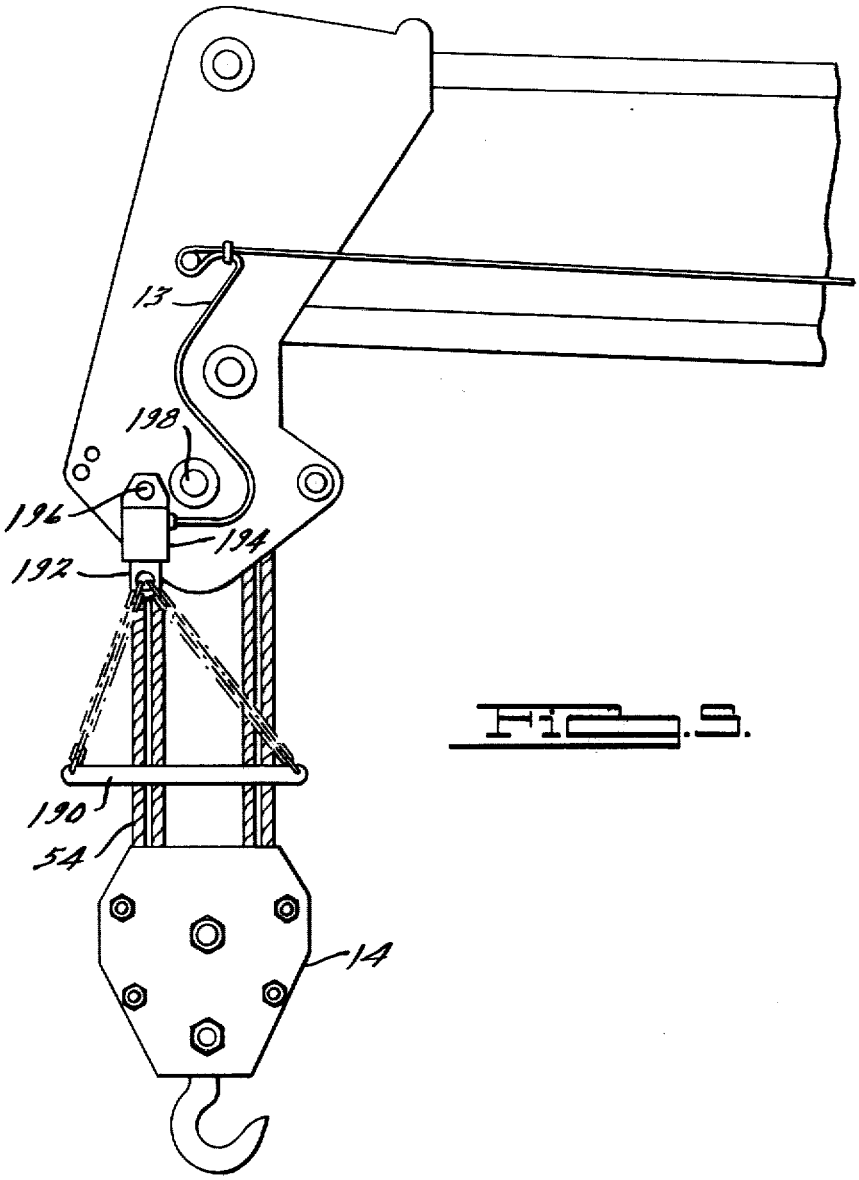

Referring to FIGS. 4A and 4B, the signal from 2-block switch 16 and 10K resistor 18 is carried by electrical cable 13 to slip rings 56, which transfer the signal out of the takeup reel of electrical cable 13, and then to window comparator circuit 22. In the present practice, cable 13 has the conductors thereof preferably formed of stainless steel for durability.

Window Comparator Circuit

The signal from 2-block switch 16 enters window comparator circuit 22 and is filtered by a 15 mf capacitor 58 and is further connected to pins 3 and 13 on a quad operational amplifier (op amp) integrated circuit. In this present practice of the invention, manufacturer's type LM224 integrated circuit, obtainable from the National Semiconductor Corporation, Semiconductor Div., 2900 Semiconductor Drive, Santa Clara, Calif. 95050, has been found satisfactory for amplifiers 60 and 62. Op amps 60 and 62 are configured to operate as voltage comparators sensing the signal on lead 64, which is biased to operate a nominal +4 volts with switch 16 closed, and at +8 volts with switch 16 open, by means of 10K resistor 66 and resistor 18. Op amp 60 will sense an open circuit condition of 2-block switch 16 or electrical cable 13 by comparing the signal on lead 64 to that on lead 68. The signal on lead 68 is biased to +5.33 volts by means of 5K resistor 70 and 10K resistor 72. Op amp 62 will sense a shorted condition of electrical cable 13 by comparing the signal on lead 64 with that on lead 74. The signal on lead 74 is biased to +2.67 volts by 10K resistor 76 and 5K resistor 78. The signal on lead 80 will be nominally at zero volts for a NORMAL condition, corresponding to +4 volts on lead 64. The signal on lead 80 will be nominal +6 volts when a 2-BLOCK condition or open or shorted cable is sensed, corresponding to a signal on lead 64 above +5.33 volts or below +2.67 volts. The signal on lead 80 is fed through 6.8K resistor 80 to a Darlington type transistor section 84. Section 84 is one of 7 identical sections provided in an integrated circuit manufacturer's type ULN-2003 obtainable from Sprague Electric Company, Semiconductor Div., 115 Northeast Cutoff, Worcester, MA 01606. Each section has internal emitter cutoff resistors 86 as shown in section 84, which are omitted from the remaining sections shown in the drawings for simplicity. The output from section 84 is coupled to the +8 volt power supply through 10K pull-up resistor 88. The output from section 84 is fed through diode 23 to relay control circuit 26 by lead 24. Zero volts on lead 80 will result in conduction of current through resistor 88 and diode 23 corresponding to a NORMAL condition. A +6 volts on lead 80 will turn on section 84 causing the signal on lead 24 to be at zero volts corresponding to a 2-BLOCK condition. The signal on lead 80 is also connected to 10K resistor 90 at the gate terminal of JFET transistor 92, which is a type 2N5555 field effect transistor in the preferred embodiment. The source terminal of JFET 92 is connected to circuit common through 1K resistor 94. The source terminal is also connected to lead 34 which may carry a logical low signal, hereafter "0" (nominally zero volts), indicative on lead 34 of a NORMAL condition, or a logical high signal, hereafter "1" (nominally +8 volts), indicative on lead 34 of a 2-BLOCK condition.

Momentarily depressing 2-BLOCK test switch 95 will simulate a short in electrical cable 13 and cause an indication of a 2-BLOCK condition, thereby permitting a test of the anti 2-BLOCK condition warning system.

Relay Control Circuit

Referring particularly to FIG. 4B, a "1" on lead 24 causes Darlington type section 96 to conduct, thereby energizing 12 volt relay 98 and closing relay contacts 28. In the preferred embodiment, section 96 is comprised of two Darlington type sections connected in parallel to provide additional drive capability for relay 98. Diode 100 is a "back" diode protecting against any inductive voltage transient when relay 98 is turned off. Darlington type section 102 senses the condition of relay 98 through 15K resistor 104. The signal on lead 51 is a "1" when relay 98 is energized in response to a NORMAL sensed condition and in the absence of an OVERRIDE state. The signal on lead 51 is a "0" when relay 98 is deenergized by a "0" on lead 24 in response to a 2-BLOCK condition. A "0" on lead 51 causes audible indicator 46 to sound a continuous tone indicative of a 2-BLOCK condition. Indicator 46 is silent in response to a NORMAL condition. In the preferred embodiment indicator 46 is manufacturer's type SC 628 manufactured by Mallory Capacitor Corporation, Mallory & Company, Inc., 4760 Kentucky Avenue, Indianpolis, IN 46241.

Logic Circuit

Referring particularly to FIG. 4B, logic circuit 36 is comprised of two integrated circuits, which in the preferred embodiment are quad 2-input NOR gates, manufacturer's type MC14001 obtained from Motorola, Inc., Semiconductor Group, Integrated Circuits Div., 2200 W. Broadway M370, Mesa, AZ 85201. Using positive logic each 2-input gate performs a logical NOR function. The circuit 36 performs an EXCLUSIVE-OR logic function considering signals on leads 34 and 44 to be inputs with an output on lead 106. That is, the signal on lead 106 will be a "1" when only one of the signals on leads 34 or 44 is a "1". When signals on leads 34 and 44 are both "1" or "0", the signal on lead 106 will be a "0". The signal on lead 38 is a logic inversion of the signal on lead 106. The signal on lead 44 is likewise a logic inversion of the signal on lead 50. The signal on lead 52 will be the same as that on lead 34 having passed through two logical inversions. Even though the signal on lead 52 is logically the same as that on lead 34, using a NOR gate output to drive lead 52 will ensure a predictable and sharp transition from a "1" to a "0" on lead 52. In the presently preferred practice, a sharp transition from logic 1 to logic zero has been found desirable in order to provide a reliable reset signal on lead 52.

Override Circuit

Referring particularly to FIG. 4A, override circuit 32 monitors override switch 48 and reset lead 52 and provides outputs on leads 33 and 50. When switch 48 is momentarily depressed, it closes the circuit between JFET transistor 108 and the +8 volt supply through 10K resistor 110. While switch 48 is closed it supplies current through 100K resistor 165, causing drain to source conduction of transistor 108. In the preferred embodiment, transistor 108 is type 2N4391. Transistor 108 charges a 0.22 mf capacitor 112, preferably of the polycarbonate type, to a nominal +8 volt when override switch 48 is closed, initiating an OVERRIDE state. Op amp 114 is connected as a non-inverting unity-gain follower with a typical input impedance of 30 megohms with 30 picofarad capacitor 116 used for stabilization and in the present practice a National Semiconductor manufacturer's type LM208 has been found satisfactory. A 10K resistor 118 couples capacitor 112 to the non-inverting input of op amp 114. Resistor 118 and the non-inverting input impedance of op amp 114 comprise a discharge path for capacitor 112.

The output from op amp 114 is connected to the non-inverting input of op amp 120 connected for operation as a comparator and for which a National Semiconductor manufacturer's type LM224 has been found suitable. The inverting input of op amp 120 is held at +2.7 volts by being connected to a voltage divider comprised of 10K resistor 122 and 5.11K resistor 124. The output from op amp 120 on lead 127 will switch to and remain at a "1" for a nominal 6 minutes after override switch 48 is depressed, corresponding to the time it takes capacitor 112 to discharge from +8 volts to +2.7 volts. As capacitor 112 discharges, the output from op amp 114 will decrease from +8 volts toward zero volts. As long as the output from op amp 114 is above a nominal +2.7 volts, the signal on lead 127 will be a "1". When the output from op amp 114 falls below +2.7 volts, the signal on lead 127 will switch to and remain at a "0". The output from op amp 120 is passed through 10K resistor 126 and diode 25 to lead 24. Diode 25 will conduct and energize relay control circuit 26 when an OVERRIDE state exists (corresponding to a "1" on lead 127). No conduction of diode 25 will occur when OVERRIDE state is absent (a "0" on lead 127).

The output of op amp 120 on lead 127 is also connected through 1.5 megohm resistor 128 to timer integrated circuit 130 (National Semiconductor manufacturer's type LM555). As configured with a 470K resistor 132 and 0.22 mf capacitor 134 and 0.01 mf bypass capacitor 136, timer 130 will operate as an astable multivibrator "gated" on by a "1" on lead 127. While "gated" on, timer 130 will cause nominal 1 hertz square wave to exist on lead 50. When the signal on lead 127 is a "0" the signal on lead 50 from timer 130 will be a "1". Op amp 120 insures that switching of the signal on lead 33 and activation of timer 130 occur at the same time.

Override circuit 32 is reset from the OVERRIDE state by means of the signal on lead 52 which is a "1" for a 2-BLOCK state and "0" for a NORMAL state. Another timer integrated circuit 148 is configured to operate as a monostable multivibrator triggered by a "1" to "0" transition on lead 52 by means of the circuit comprised of a 1K resistor 138, a 0.001 mf capacitor 140, a 0.01 mf capacitor 142, a 1 megohm resistor 144 and 15 megohm resistor 146. A 0.01 mf bypass capacitor 150 is provided. A one megohm resistor 152 and a 0.22 mf capacitor 154 cause timer 148 to provide a nominal 0.5 second "1" reset pulse on lead 156. Lead 156 is connected to the input of tri-state gate integrated circuit 160 and to 100K resistor 158 which provides a fixed impedance to ground on lead 156. In the preferred embodiment, gate 160 is comprised of Motorola manufacturer's type MC14007 "Dual Complimentary Pair plus Inverter" integrated circuit connected per the manufacturer's recommendations to provide the function of a tri-state gate which has an "open circuit" output condition in addition to an ability to provide a "1" and a "0". As configured in FIG. 4A gate 160 will provide only a "0" and "open" output. When an "0" exists on lead 156, gate 160 will appear to be an open circuit to lead 162. When a "1" (reset pulse) exists on lead 156, the output of gate 160 will pull lead 162 to a nominal zero volts. When the output of gate 160 is "open", it has no effect on subsequent circuitry. When lead 162 goes to a nominal zero volts, it will discharge capacitor 112 through diode 164, and 15 picofarad capacitor 166.

Indicator Circuit

Referring now particularly to FIG. 4B, indicator circuit 40 receives inputs on leads 38, 44 and 51. A logic "1" on lead 38 corresponds to a NORMAL state and will cause visual indicator 42 to turn on and remain on through Darlington type section 168. In the presently preferred practice, visual indicator 42 is a conventional incandescent lamp; however, it will be apparent to these skilled in the art that other type of indicators may be used. The signal on lead 38 will be an "0" for a 2-BLOCK state causing indicator 42 to remain off. When an OVERRIDE state exists, the signal on lead 38 will pulsate in synchronism with the signal on lead 50 causing lamp 42 to flash on and off. Test switch 170 permits the operator to verify that indicator 42 is in working condition when the signal on lead 38 is an "0". The signal on lead 44 is connected through a 27K resistor 172 to Darlington type section 176. A 4.7K resistor 174 connects section 176 to audible indicator 46. When indicator 46 is energized through lead 44, resistors 172 and 174 provide a reduced volume from audible indicator 46. The signal on lead 44 is a logical inversion of the signal on lead 50 and hence provides a pulsing tone from indicator 46 when an OVERRIDE state exists.

Power Supply Circuit

Referring again particularly to FIG. 4A, system power is provided through power supply circuit 210 which receives power from a 12 volt battery 212. A one amp type 3AG fuse 214 is connected in series with the positive battery lead for circuit protection. A type IN4001 diode 216 is in series with fuse 214 to protect against accidental reverse connection of battery 212. Two 0.22 mf capacitors 218 are connected across the supply leads with their common connection to chassis ground at lead 220 to filter noise on the supply leads. Two 100 millihenry inductors 222 are provided to filter noise, as is a 20 mf capacitor 224. The signal on lead 226 is a filtered nominal +12 volts and provides the "+12v" power to the points so marked in FIGS. 4A and 4B. A suitable voltage regulator 230 (as for example a manufacturer's type uA723M available from Fairchild Semiconductor Corporation, 464 Ellis, Mountain View, Calif. 94042) provides +8 volt power on lead 228 to the points so marked in FIGS. 4A and 4B.

Two-Block Sensor

Referring to FIG. 5, the sensor is shown in a NORMAL condition. In this condition, ring 190 encircles a reeving of hoist cable 54 and is suspended from plunger or tongue 192; and the weight of ring 190 draws tongue 192 vertically downward from 2-block switch enclosure 194. Housing or enclosure 194 is pinned at and free to pivot about point 196 to maintain vertical alignment of enclosure 194 as the orientation of the crane boom is varied. Upper load block 12 rotates about pivot point 198.

Raising movable hook block 14 into contact with ring 190 will relieve tongue 192 of the weight of ring 190 permitting tongue 192 to retract into enclosure 194.

Figure 8:
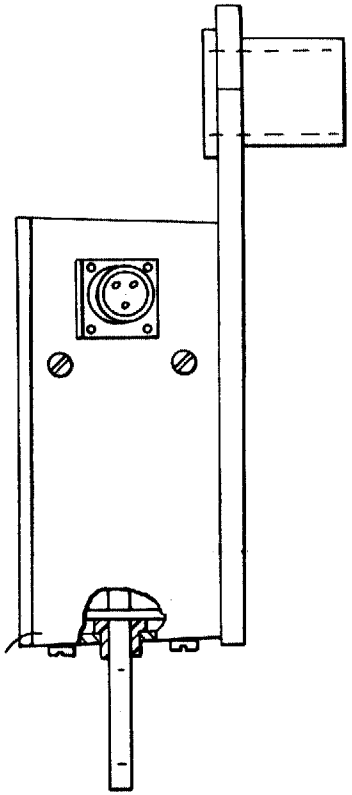
FIG. 8 is a right side view of the sensor of FIG. 6 with a portion of the housing removed.
Figure 6:
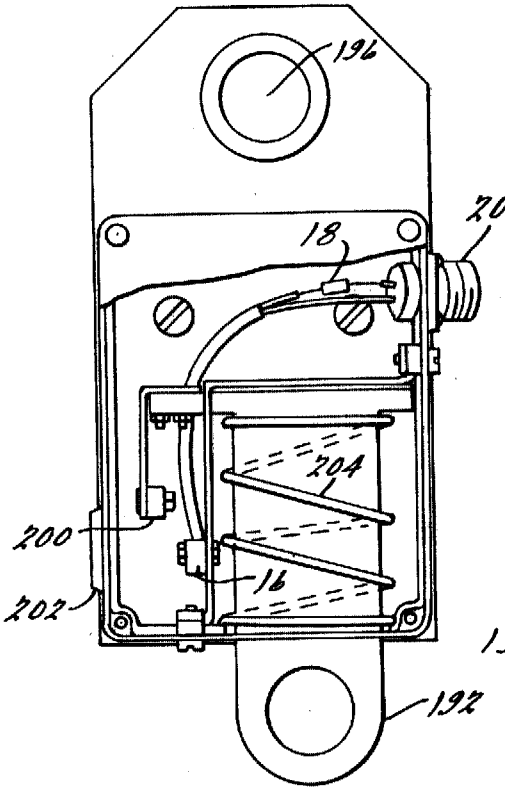
FIG. 6 is a side elevation view of the 2-BLOCK sensor with portions of the housing broken away.
Figure 7:
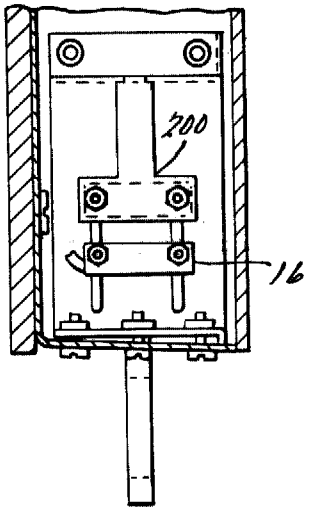
FIG. 7 is a left side view of the sensor of FIG. 6 with housing removed.

Referring to FIGS. 6, 7, and 8, tongue 192 is shown fully retracted into enclosure 194 corresponging to a 2-BLOCK condition. In the preferred embodiment, 2-block switch 16 and magnet 200 are comprised of a manufacturer's type RS-51 hermetically enclosed reed switch and permanent magnet set manufactured by Alco Electronic Products, Inc., Div. Augat Inc., 1551 Osgood Street, North Andover, MA 01845. As shown in FIG. 6, switch 16 is normally open representing its 2-BLOCK condition. Tongue 192 is urged toward its fully retracted position by a spring 204. A permanent magnet 200 is attached to and moves with tongue 192. As tongue 192 moves vertically downward from enclosure 194 under the weight of ring 190, magnet 200 will move vertically to a position adjacent switch 16 when the tongue 192 is in its fully extended position. When magnet 200 is adjacent switch 16 the magnet force causes switch 16 to close. Housing 194 has an access cover 202 which may be removed to permit adjustment of the mounting location of switch 16 to insure proper operation. An electrical connector 206 permits connection of electrical cable 13 to switch 16 and resistor 18.

What is claimed is:

1. A detector assembly comprising:

a. processing means adapted to receive a two state sensed condition input signal and an override input signal and operable to provide first and second control signals and NORMAL, 2-BLOCK, and OVERRIDE state signals in response thereto; and b. indicator means connected to said processing means and capable of indicating three distinct states in response to said NORMAL, 2-BLOCK, and OVERRIDE state signals, wherein said processing means is operable to provide said NORMAL state signal to said indicator means and to provide said first control signal upon receipt of a first sensed condition input signal and in the absence of an override input signal, said processing means is operable to provide said 2-BLOCK state signal to said indicator means and to provide said second control signal upon receipt of a second sensed condition input signal and in the absence of an override input signal, said processing means is further operable to provide said OVERRIDE state signal to said indicator means and to provide said first control signal upon receipt of either of said sensed condition input signals and in the presence of said override input signal.

2. The detector assembly of claim 1, wherein said processing means is further operative to automatically terminate operation in an OVERRIDE state after a predetermined time interval and provide a signal to the indicating means representative of the state of said sensed condition input after said time interval of operation in said OVERRIDE state.

3. The detector assembly of claim 1, wherein said processing means will reset to a NORMAL state upon receipt of transition from said second to said first sensed condition input.

4. An automatic resetting anti 2-BLOCK condition warning and control system having NORMAL and 2-BLOCK states for use with a crane having a movable hook block suspended from a lifting point on the crane, said system comprising:

a. sensor means operative to sense proximity of said movable block to said lifting point and provide a signal indicative of said proximity;

b. processing means operative in response to said proximity signal to change operation from said NORMAL to said 2-BLOCK state; and c. means selectively operable to provide an override input signal to said processing means;

wherein said processing means is operable i. in the absence of both said proximity signal and said override signal to provide NORMAL state operation, ii. in the absence of said override signal and upon receipt of said proximity signal to provide 2-BLOCK state operation, and iii. upon receipt of said override signal to provide OVERRIDE state operation for a predetermined time period and upon lapse of said time period while in receipt of said proximity signal to change operation to said 2-BLOCK state such that movement of said movable block toward said lifting point is substantially restricted with respect to such movement in said NORMAL state.

5. The system defined in claim 4, further comprising indicator alarm means operative to provide distinct alarm indications when said processing means is in each of said NORMAL, 2-BLOCK, and OVERRIDE states.

6. The system defined in claim 4, further comprising alarm means operable to provide distinct alarm indications of said 2-BLOCK and OVERRIDE states, said alarm indications each selected from the group consisting of visual and audible alarms.

7. An anti 2-BLOCK proximity sensor for use with a crane having a movable block suspended from a lifting point on the crane, said sensor comprising:

a. housing means having portions thereof pivotally attached to the crane structure closely adjacent the lifting point such that said housing means is suspended from said pivoted attachment;

b. plunger means movably received in said housing means and including structure extending exteriorly of said housing means and adapted for contacting said movable block when same is proximate said lifting point structure, said plunger means further including structure within said housing means having magnet means provided thereon for movement with respect to said housing means;

c. magnetically actuated switch means disposed within said housing means, said switch means being disposed such that a predetermined movement of said plunger means causes said magnet means to pass closely adjacent said switch means to provide actuation thereof; and, d. means disposed exteriorly of said housing means providing for electrical circuit connection to said magnetically actuated switch means.

8. An anti 2-BLOCK sensor for use with a crane having a movable block suspended from a lifting point on the crane, said sensor comprising:

a. housing means having portions thereof pivotally attached to the crane structure closely adjacent the lifting point such that said housing means maintains vertical alignment as orientation of said crane structure is varied;

b. plunger means movable received in said housing means and including structure extending exteriorly of said housing means and adapted for contacting said movable block when same is proximate said lifting point structure, said plunger means further including structure within said housing means having actuation means provided thereon for movement with respect to said housing means;

c. switch means disposed within said housing means, such that a predetermined movement of said actuation means causes actuation of said switch means; and, d. means disposed exteriorly of said housing means providing for electrical circuit connection to said switch means.

9. The sensor defined in claim 8, wherein a. said switch means is magnetically actuated; and b. said actuation means includes magnet means affixed to said plunger means structure; wherein movement of said plunger means causes activation of said switch means by said magnet means.

10. The sensor defined in claim 8, wherein said switch means is comprised of a switch whose contacts are hermetically sealed.

11. A 2-block condition crane warning system comprising:

a. processing means adapted to receive a two state sensed condition input signal and an override input signal and operable to provide first and second control signals and NORMAL, 2-BLOCK and OVERRIDE state signals in response thereto;

b. indicator means connected to said processing means and capable of indicating three distinct states in response to said NORMAL, 2-BLOCK, and OVERRIDE state signals; and c. crane control means responsive to first and second control signals from said processing means, wherein said processing means is operable to provide i. said NORMAL state signal to said indicator means and said first control signal to said crane control means upon receipt of a first sensed condition input signal and in the absence of an override input signal, ii. said 2-BLOCK state signal to said indicator means and said second control signal to said crane control means upon receipt of a second sensed condition input signal and in the absence of an override input signal, and iii. said OVERRIDE state signal to said indicator means and said first control signal to said crane control means upon receipt of either of said sensed condition input signals and in the presence of said override input signal, wherein said indicator means is operative to provide different indications in response to each of said NORMAL, 2-BLOCK, and OVERRIDE state signals and wherein said crane control means is operable to perform a function in response to said first control signal and inoperable in response to said second control signal.

12. An automatic resetting anti 2-BLOCK condition warning and control system having NORMAL and 2-BLOCK states for use with a crane having a movable hook block suspended from a lifting point on the boom, said system comprising:

a. sensor means operative to detect proximity of said movable block to said lifting point;

b. processing means responsive to said sensor means and operative to change from said NORMAL to said 2-BLOCK state when said sensor means detects proximity of said movable block to said lifting point, wherein operation in said 2-BLOCK state is more restrictive of movement of said movable block than in said NORMAL state;

c. indicator means connected to said processing means and operative to indicate said 2-BLOCK state during proximity of said movable block to said lifting point;

d. reset means responsive to said sensor means and operative to return said processing means operation from said 2-BLOCK state to said NORMAL state when said movable block is no longer in proximity to said lifting point; and e. override means selectively operable to permit operation in an OVERRIDE state in the same manner as in said NORMAL state during said proximity of said movable block to said lifting point and wherein said indicator means is operative to indicate said OVERRIDE state.

13. An automatic resetting anti 2-BLOCK condition warning and control system having NORMAL and 2-BLOCK states for use with a crane having a movable hook block suspended from a lifting point on the boom, said system comprising:

a. sensor means operative to detect proximity of said movable block to said lifting point;

b. processing means responsive to said sensor means and operative to change from said NORMAL to said 2-BLOCK state when said sensor means detects proximity of said movable block to said lifting point, wherein operation in said 2-BLOCK state is more restrictive of movement of said movable block than in said NORMAL state;

c. indicator means connected to said processing means and operative to indicate said 2-BLOCK state during proximity of said movable block to said lifting point;

d. reset means responsive to said sensor means and operative to return said processing means operation from said 2-BLOCK state to said NORMAL state when said movable block is no longer in proximity to said lifting point;

e. override means selectively operable to permit operation in an OVERRIDE state in the same manner as in said NORMAL state during said proximity of said movable block to said lifting point; and f. timing means determinative of the duration of operation in the OVERRIDE state and operative to terminate operation in said OVERRIDE state and restore operation according to i. said 2-BLOCK state when said movable block is proximate said lifting point, or ii. said NORMAL state when said movable block is not proximate said lifting point.

* * * * *